United States Patent [19]

Hobson

[11] Patent Number: 4,467,893

[45] Date of Patent: Aug. 28, 1984

[54] FOLDING FORK LIFT WITH A MULTIPLE TELESCOPING TOP LIFT ATTACHMENT

[76] Inventor: Lloyd L. Hobson, 312 North East St., Elnora, Ind. 47529

[21] Appl. No.: 399,335

[22] Filed: Jul. 19, 1982

[51] Int. Cl.[3] ..... B66B 9/20

[52] U.S. Cl. ..... 187/9 R; 414/607; 182/69; 74/110

[58] Field of Search ..... 187/9 R, 9 E, 18, 8.71, 187/8.72; 254/122; 182/63, 69, 157, 158, 141; 414/785, 607, 608; 74/110, 521

[56] References Cited

U.S. PATENT DOCUMENTS 2,840,347 6/1958 Feucht ..... 74/110

2,915,144 12/1959 Olson ..... 187/9 E 3,010,328 11/1961 Foley ..... 74/110

4,114,854 9/1978 Clark ..... 187/18

*Primary Examiner*—Joseph J. Rolla

*Assistant Examiner*—Kenneth Noland

*Attorney, Agent, or Firm*—Barnes & Thornburg

[57] ABSTRACT

An attachment for a lift truck includes a base unit attachable to a vertically movable carriage of the lift truck, a lower stage slidably engaged on the base unit, at least one upper stage slidably engaged to the base unit, and a telescoping apparatus for upwardly telescoping the at least one upper stage relative to the base unit simultaneously with a downward motion of the base unit with respect to the lower stage.

13 Claims, 8 Drawing Figures

FOLDING FORK LIFT WITH A MULTIPLE TELESCOPING TOP LIFT ATTACHMENT

The present invention is directed generally to off-road wheeled article-handling devices generally referred to as industrial fork lift trucks. The invention is more particularly directed to attachments to be applied to the vertically movable carriage of a fork lift truck, which attachment is particularly useful in restricted overhead space situations and includes a telescoping feature.

A great variety of special article handlers have been developed which are intended for use with conventional fork lift trucks. A substantial number of the devices require electrical or hydraulic hook-up to the available systems on the fork lift trucks, which hook-up in turn requires the specific presence of either the electrical system or the hydraulic system in the fork lift truck. Conventional fork lift trucks usually include an electrical or hydraulic drive system, but usually not both. Hence, attachment mechanisms which require the specific application of either electrical or hydraulic hook-up tend to exclude a significant portion of available lift trucks due to their non-compatibility. The present invention is designed to derive the necessary power to operate the telescoping feature of the attachment merely from the vertical movement of the conventional carriage which is present on all standard lift trucks.

Specific attachments have been designed for the placement and retrieval of containers of goods at various elevated heights, but few are specifically intended to place or retrieve containers in restricted overhead space situations such as within the confines of an over-the-road tractor trailer. Fewer still are capable of operating in such a restricted head space which also include features for both top handling and bottom handling of goods. The present invention includes the features and capabilities by incorporating forks which are foldable to a vertical position and a top lift support which is vertically adjustable to various heights by means of a telescoping mechanism.

Generally, the invention may be viewed as an attachment which includes a base unit which is attachable to the vertically movable carriage of a lift truck. The attachment also comprises a lower stage which is slidably engaged on the base unit and is free to move vertically with respect to the base under the influence of gravity alone. Generally, the lower stage remains in substantially continuous contact with the ground so long as the base is not raised above a fixed maximum height established by the overall dimension of the lower stage. The attachment further includes at least one upper stage slidably engaged to the base unit, which upper stage is intended to carry one or more top lift blades or other means for top-handling containers or goods. There is also provided a telescoping means for upwardly telescoping the upper stage relative to the base unit simultaneously with a downward motion of the base unit with respect to the lower stage. The motion of the base unit with respect to the lower stage is provided by the vertical motion of the carriage of the lift truck, and in this manner no auxiliary electrical or hydraulic power hoook-up is necessary between the lift truck and the attachment of the present invention.

The preferred telescoping means includes a plurality of scissors joined together to form a lazy tongs drive mechanism, the ends of the lazy tongs drive mechanism being slidably connected to the base and upper stage. The lower stage includes a selectively engageable latch pin which, when appropriately positioned, interacts with the telescoping lazy tong drive mechanism. The downward motion of the base and the lowermost extremity of the lazy tongs drive mechanism relative to the engaged latch pin of the lower stage causes the upper end of the lazy tongs mechanism to lift the upper stage or stages to the desired position.

The overall height dimension of the attachment can be minimized by the incorporation of further upper stages, thereby permitting each upper stage to have a shorter height dimension. Thus, when the apparatus is contracted to its smallest vertical dimension, and secured in this position, bottom handling of containers and goods with the aid of folding forks in minimum overhead space condition is achievable.

Additional features and advantages of the event will become apparent to those skilled in the art upon consideration of the following detailed description of a preferred embodiment exemplifying the best mode of carrying out the invention as presently perceived. The detailed description particularly refers to the accompanying figures in which.

Figure 1:
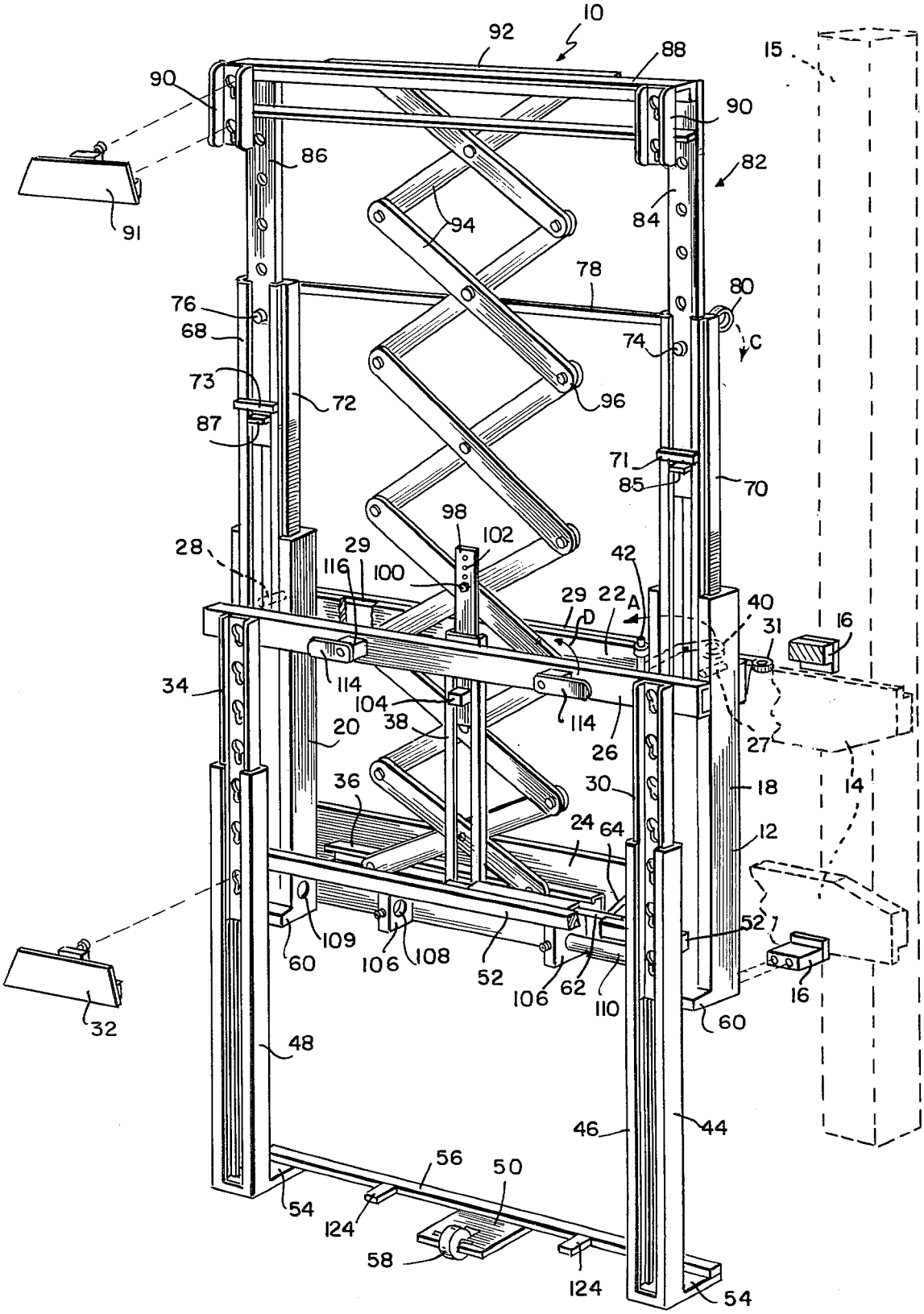
Fig. 1 is a perspective view of a multiple telescoping top lift attachment according to the present invention.

As shown in the accompanying figures, an attachment 10 of the present invention comprises a base unit 12 which is attachable to the vertically movable carriage 14 of a lift truck 15, shown in phantom in FIG. 1, by means of standard hook-type mountings 16. The base 12 includes a pair of parallel box channels 18 and 20 fixed with respect to each other on their back surface by cross members 22 and 24 and on their front surface by cross member 26. Two vertically arranged U-channels 30 and 34 are fixed to the front of cross member 26 and extend downward to stop members 60 on the lower leading edge of channels 18 and 20, the U-channels being adapted to engage load supports 32 shown to be top-lifting blades. A support channel 36 is fixed to the front of cross member 24, while guide channel 38 is fixed to a back surface of cross member 26.

A first latch pin handle 40 is pivotally supported on an inside surface of vertical box channel 18, the handle 40 causing the pivotal rotation (Arrow A) of square rod 42 about a vertical axis, the rod 42 extending substantially over the vertical extent of box channel 18. A pair of latch pins 27 and 28 are pivotally supported on box members 18 and 20, respectively, and are adapted for engagement with middle stage 68 described below. The latch pins 27 and 28 are tied together by rod 29 and actuated by a second latch pin handle 31.

The attachment 10 also comprises a lower stage or shoe 44 which is basically L-shaped in side elevation and comprises two box channel members 46 and 48 which are slidably engaged on vertical channel members 30 and 34 of base 12. Channel members 46 and 48 are tied together by a horizontally extending tie bar 52. Members 46 and 48 have at their lower ends rearward extending foot plates 54 which are joined together at a back edge by tie bar 56. A wheel member 58 is included in the foot plate 50 to support the ground-engaging shoe 44 so as to prevent abrasive wear of foot plates 54. The shoe or lower stage 44 is free to move vertically with respect to base 12 under the influence of gravity alone, thereby maintaining shoe 44 in substantially continuous contact with the ground so long as base 12 is not raised above the maximum height of shoe 44. Stop members 60 on the lower leading edge of channels 18 and 20 of base 12 interact with horizontal tie rod 52 on the back surface of box channels 46 and 48 to define the lowermost position of shoe 44 with respect to base 12. A latch pin 62 is slidably supported on a rear surface of horizontal tie rod 52 and is movable with respect thereto by arm 64 extending from a sleeve which is slidably received on square rod 42. The function of latch pin handle 40, rod 42, latch pin 62, and arm 64 will become apparent from the discussion of operation of the apparatus which follows.

The attachment 10 further comprises a middle stage 68 which comprises a pair of box channel members 70 and 72 which are slidably received within box channel members 18 and 20 of base 12, respectively. A pair of latch pins 74 and 76 are pivotally mounted on a rear surface and near the top of box channels 70 and 72, respectively. The latch pins 74 and 76 are connected together by connecting rod 78 extending therebetween and are actuated by third latch pin handle 80 movable per arrow C. Stage lift bars 71 and 73 are provided on a front surface of channels 70 and 72, respectively, for engagement with top stage unit 82 described below.

The attachment 10 further comprises top stage unit 82 which comprises bars 84 and 86 which are slidably received within channels 70 and 72 of middle stage 68, respectively. The vertical bars 84 and 86 are tied together at their top end by tie bar 88 which extends forward from vertical bars 84 and 86 to a line substantially coplanar with the front surface of member 26 of base 12. Two channel supports 90 are fixed to a front surface of top member 88 for supporting top lifting blades 91 or other similar load-supporting means. On the back surface of top member 88 there is located a top scissor support 92.

Between the top scissor support 92 and the bottom scissor support 36 there are a plurality of scissors 94 joined end-to-end together to form a lazy tongs or a pantagraph 96. A bar 98 is attached to a crossing point of one of the scissors 94 by means of a bolt 100 passing through one of a plurality of apertures 102 in the upper end of the bar 98. The bar 98 extends downwardly along the vertical axis of the pentagraph 96 into guide channel 38. A push block 104 is located at a lower end of bar 98 and interacts with latch pin 62 in the manner hereafter described. Stops 85 and 87 are provided on the lower ends of bars 84 and 86, respectively, for engagement with middle stage lift bars 71 and 73, respectively.

Figure 3:
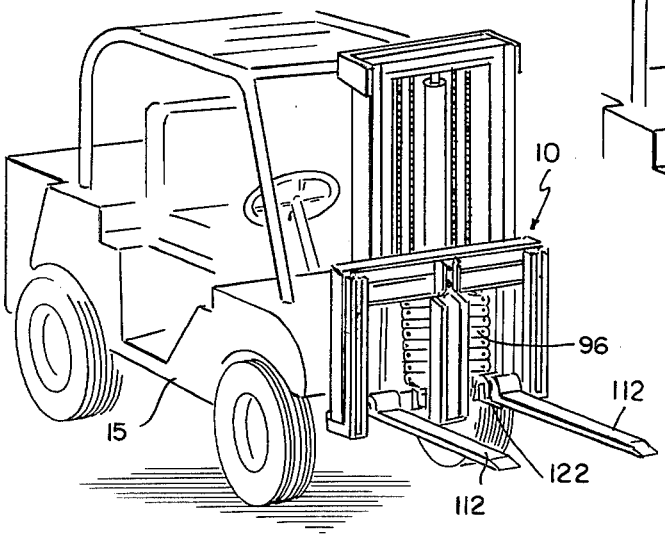
FIG. 3 is a perspective view similar to FIG. 2 but with the attachment in its lowermost profile position and the pivotal forks extended.
Figure 2:
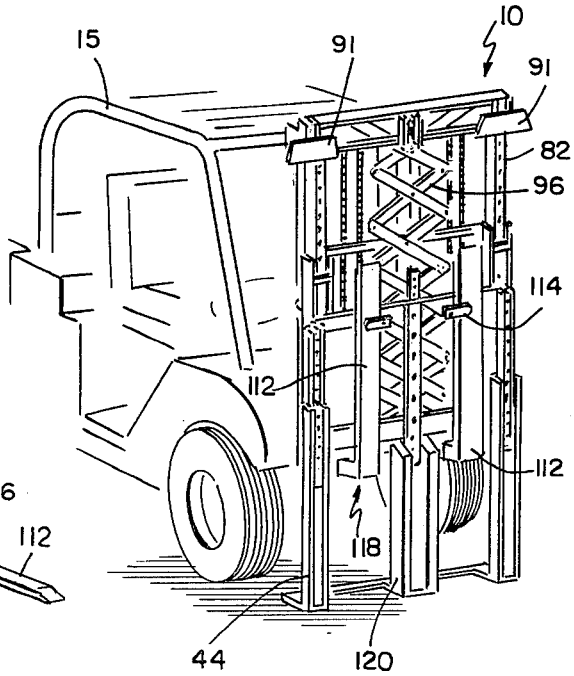
FIG. 2 is a perspective view of the invention shown in FIG. 1 attached to a fork lift truck.

The base unit 12 further includes fork support blocks 106 fixed to the forward-facing lower portion of lower cross member 24. Each support block includes a pivot pin aperture 108 into which a pivot pin may be inserted to support a folding fork. The pin 110, shown only on the right side of the apparatus 10 in FIG. 1, extends between block 106 and the next adjacent vertical box channel 18 or 20. The channels 18 and 20 have a matching aperture 109 for receiving the end of pivot pin 110 not received by aperture 108. The forks 112 mounted on pivot pin 110 are preferably of the folding type as shown in FIGS. 2 and 3. When the forks are folded up in to a vertical orientation as shown in FIG. 2, they are retained in that position by retainers 114 pivotally mounted to the front of cross member 26 on pivot blocks 116. The forks are supported when in their lowered position by the proximal end 118 of the fork abutting the front surface of lower cross member 24 of base unit 12. A lug 122 on the inside of each fork pivots under catches 124 on the bar 56 to retain the lower stage 44 with the base unit 12 when the forks are in their lowered position as shown in FIG. 3.

Figure 4:
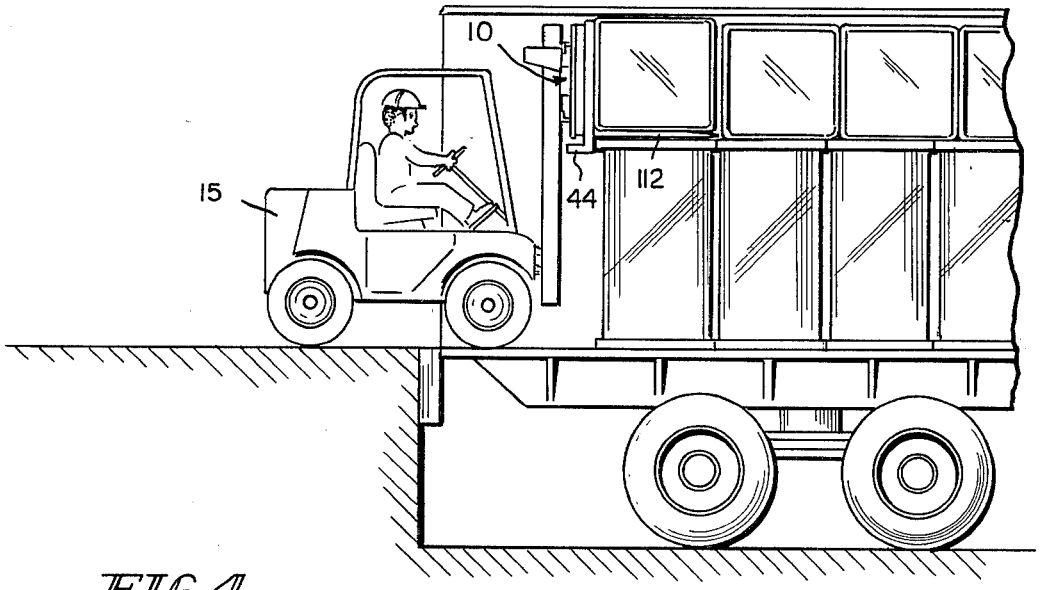
FIG. 4 is a schematic plan view showing the utility of the invention when the attachment is configured as illustrated in Fig, 3.

As shown in FIG. 2, the lower stage 44 includes a bumper box 120 which extends vertically from the foot plate 50, the bumper box acting to prevent impalement of goods or containers by the apparatus. The bumper box 120 is not shown in FIG. 1 for purposes of clarity. As shown in FIG. 2, the attachment 10 is in its vertically extended position and is generally employed in this position with top-lifting blades 91 to lift capped cartons containing appliances or other goods by their top cap. The attachment 10 can be compressed as hereinafter described to achieve a very low profile as shown in FIGS. 3 and 4. This low profile arrangement is particularly advantageous when attempting to load goods in a restricted overhead space area as shown in FIG. 4 which schematically illustrates a fork lift truck 15 loading or unloading the interior of a tractor trailer. It is to be noted that in FIGS. 1 and 2, the lazy tongs or pantagraph mechanism 96 is in an extended condition, while in FIGS. 3 and 4, the telescoping mechanism 96 is in its compressed condition.

Figure 5:
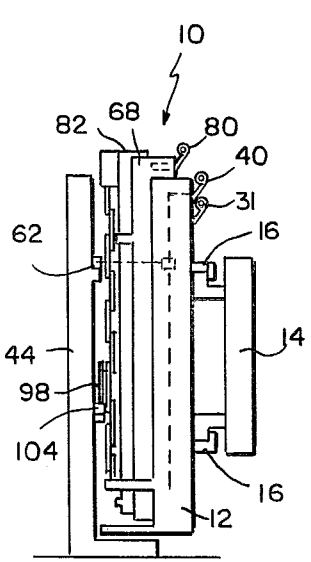

FIGS. 5–8 schematically illustrate the sequence of steps necessary to change the vertical aspect of the attachment 10. In FIGS. 5–8, the front-to-back positions of the various principal elements of the apparatus have been varied from that shown in FIG. 1 so as to permit a clear understanding of the function of each part of the combination forming the apparatus 10. The attachment 10 is shown in FIG. 5 in its lowermost attitude or position, and it is in this configuration that a lift truck including a vertically movable carriage 14 would be secured to base 12 by means of hook-type mountings 16. In this position or attitude, the overall vertical dimension of the attachment 10 is insignificantly greater than the vertical dimension of the largest of the various principal elements or stages 12, 44, 68, and 82. Further, as shown in FIG. 5, the push block 104 on the lower end of bar 98 is located below sliding latch pin 62 on lower stage 44.

Figure 6:
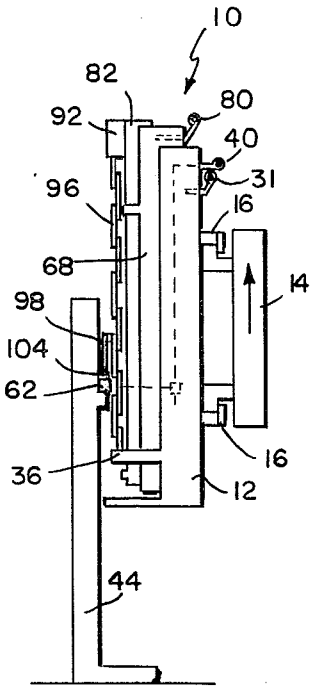

To initiate the vertical extension of the attachment 10, the carriage of the lift truck is caused to move upward to the position shown in FIG. 6 where block 104 on bar 98 is now located above latch pin 62. The first latch pin handle 40 is caused to pivot in a manner such that the latch pin 62 is engaged with the lower surface of push block 104. The carriage 14 of the lift truck is then moved downward to reassume the position shown in FIG. 5 which is equivalent with the position shown in FIG. 7.

Figure 7:
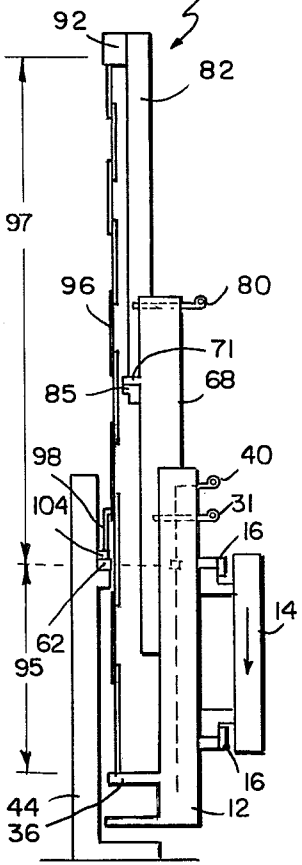

As the carriage 14 of the lift truck moves from the position shown in FIG. 6 to the position shown in FIG. 7, the latch pin 62 remains continuously in contact with the push block 104 on bar 98 fixing its position relative to the lower stage 44. The lower end of the telescoping means 96 carried by support channel 36 moves downwardly with the base 12 to which it is attached, thereby enlarging the vertical dimension of the lower portion 95 of the pantagraph 96. This enlargement of the vertical dimension of the lower portion 95 of pantagraph 96 causes a similar enlargement of the upper portion 97 of pantagraph 96. The upper end of the pantagraph 96 is retained in top support 92 fixed to upper stage 82. The vertical rise of top support 92 causes the upper stage 82 to be carried vertically upward. As the upper stage 82 moves upward, stops 85 and 87 at the lower ends of bars 84 and 86 contact the underside of lift bars 71 and 73 provided on the front surface of channels 70 and 72 of middle stage 68, thereby lifting the middle stage 68 vertically with respect to base 12. At this point, the second latch pin handle 31 is actuated so as to engage pins 27 and 28 between the base and middle stage. Similarly, third latch pin handle 80 is actuated so as to engage latch pins 74 and 76 between the middle stage and upper stage. With the latch pins 27, 28, 74, and 76 thus engaged, the carriage 14 of the lift truck can again be moved upward as desired, the middle stage 68 and the upper stage 82 being carried upward by base 12 as shown in FIG. 8.

Figure 8:
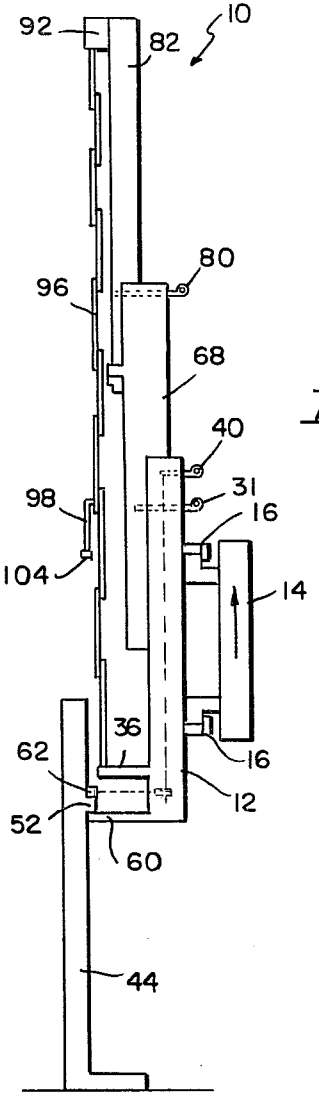
FIGS. 5–8 are schematic illustrations showing serially the expansion and contraction of the telescoping attachment shown in FIG. 1.

As the attachment moves from the position shown in FIG. 7 to the position shown in FIG. 8, the push block 104 on bar 98 moves out of contact with latch pin 62 on lower stage 44. Further, as the attachment 10 reaches the point shown in FIG. 8, the stop members 60 on the lower leading edge of base 12 engage horizontal tie bar 52, thereby carrying the lower stage 44 vertically with the remainder of the apparatus 10. To compress the apparatus from the attitude shown in FIG. 8 to the attitude shown in FIG. 5, the steps just discussed should be reversed. A significant feature of the process illustrated in FIGS. 5–8 is that the vertical enlargement of the apparatus between FIGS. 6 and 7 is caused by the downward motion of the carriage 14 of the lift truck, thereby causing simultaneous motion of base 12 and the upward extension of upper stage 82 due to the action of the lower stage latch pin 62 on push block 104 fixed to bar 98 of lazy tongs telescoping means 96.

Although the invention has been described in detail with reference to the illustrated preferred embodiment, variations in modifications can exist within the scope and spirit of the invention as described above and as defined in the following claims.

What is claimed is:

1. An attachment for a lift truck comprising:

a base unit attachable to a vertically movable carriage of the lift truck, a lower stage slidably engaged on the base unit, at least one upper stage slidably engaged to the base unit, and telescoping means for upwardly telescoping the at least one upper stage relative to the base unit simultaneously with a downward motion of the base unit with respect to the lower stage.

2. The attachment of claim 1 wherein the lower stage further comprises:

means for selectively engaging the telescoping means and wherein the base unit and the at least one upper stage comprises members permanently engaged with the telescoping means.

3. The attachment of claim 2 wherein the telescoping means comprises:

a plurality of scissors joined together to form a lazy tong drive mechanism, and means for slidably engaging the ends of the lazy tong drive mechanism to said members.

4. The attachment of claim 3 wherein the means for selectively engaging the telescoping means comprises:

a latch pin slidably mounted to the lower stage and releasably engageable with the lazy tongs drive mechanism.

5. The attachment of any of claims 1–4 wherein the at least one upper stage further comprises:

means for lockably engaging the at least one upper stage in a raised position.

6. The attachment of claim 5 wherein the at least one upper stage further comprises at least one lifting blade for top handling material.

7. A telescoping lift attachment, comprising:

a base unit attachable to a vertically movable carriage, the base unit having a cross member, at least one pair of parallel vertical members attached to the cross member, a lower stage having a pair of parallel vertical members slidably engaged on the at least one pair of parallel vertical members of the base unit, at least one upper stage, the at least one upper stage having a pair of parallel vertical members slidably engaged to the at least one pair of parallel vertical members of the base unit, and telescoping means for upwardly telescoping the at least one upper stage relative to the base unit simultaneously with a downward motion of the base unit with respect to the lower stage.

8. The telescoping lift attachment of claim 7 wherein the lower stage further comprises means for selectively engaging the telescoping means and wherein the base unit and the at least one upper stage further comprises support cross members slidably engaged with the telescoping means.

9. The telescoping lift of claim 8 wherein the telescoping means comprises a plurality of scissors joined together to form a lazy tong drive mechanism, and means for slidably engaging the ends of the lazy tong drive mechanism to said support cross members.

10. The telescoping lift attachment of claim 7 wherein the base unit further comprises:

a pair of forks, hinging means for hingedly attaching the pair of forks, and retaining means for retaining the pair of forks in a position vertically parallel to and flush with said base unit.

11. A multiple telescoping lift attachment to a lift truck, the attachment comprising:

a base unit attachable to a vertically movable carriage, the base unit having a cross member, a first pair of parallel vertical members attached to one face of the cross member, and a second pair of parallel vertical members attached to the opposite face of the cross member, a lower stage having a pair of parallel vertical members slidably engaged on the first pair of parallel vertical members of said base unit, a support cross member and a latch pin slidably mounted to the support cross member, at least one upper stage, the at least one upper stage having a pair of movable parallel vertical members slidably engaged to the second pair of parallel vertical members of said base unit, a support cross member attached to the pair of movable parallel vertical members, and means for lockably engaging the at least one upper stage in a raised position, and a telescoping means for upwardly telescoping the at least one upper stage relative to the base unit simultaneously with a downward motion of the base unit with respect to the lower stage, the telescoping means having a plurality of scissors joined together to form a lazy tongs drive mechanism, slidably engaged at either end with the support cross members of the base unit and the at least one upper stage and selectively engaged at the latch pin of said lower stage.

12. The multiple lift attachment of claim 11 wherein the at least one upper stage comprises:

a first and a second upper stage, the first upper stage having a first pair of movable parallel vertical members slidably engaged to said second pair of parallel vertical members of said base unit, a cross member attached to the first pair of movable vertical parallel members, and means for lockably engaging the first and second stages in a raised position, and the second upper stage having a second pair of movable parallel vertical members slidably engaged to the first pair of movable parallel vertical members of the first upper stage and a support cross member attached to the second pair of movable parallel vertical members.

13. The multiple lift attachment of claim 11 or 12, further comprising:

a pair of forks attached at right angles to the base unit.

* * * * *